US006004102A

United States Patent [19]

Kuefner et al.

[11] Patent Number: 6,004,102

[45] Date of Patent: Dec. 21, 1999

[54] TURBINE BLADE FOR USE IN THE WET STEAM REGION OF PENULTIMATE AND ULTIMATE STAGES OF TURBINES

[75] Inventors: Gustav Kuefner, Nuremberg; Horst Mueller, Weinberg; Martin Breindl, Neumarkt; Bernd Sokol, Burgthan; Walter Zeisler, Nuremberg, all of Germany

[73] Assignee: ABB Patent GmbH, Mannheim, Germany

[21] Appl. No.: 08/909,219

[22] Filed: Aug. 11, 1997

Related U.S. Application Data

[63] Continuation of application No. PCT/EP96/05427, Dec. 5, 1996.

[30] Foreign Application Priority Data

Dec. 9, 1995 [DE] Germany ..... 195 46 008

[51] Int. Cl.[6] ..... F01D 5/28

[52] U.S. Cl. ..... 416/228; 416/236 R; 416/241 R; 416/224; 416/196 R

[58] Field of Search ..... 416/196 R, 224, 416/228, 235, 236 R, 236 A, 237, 241 R, 241 B, 223 R, 223 A; 415/914; 29/889.1, 889.7, 889.71

[56] References Cited

U.S. PATENT DOCUMENTS

| | | | |
|---|---|---|---|
| 1,862,827 | 6/1932 | Parsons et al. | 416/228 |
| 3,834,833 | 9/1974 | Faber et al. | 416/224 |
| 4,720,239 | 1/1988 | Owczarek | 415/914 |
| 4,869,644 | 9/1989 | Takigawa | 416/235 |
| 5,074,376 | 12/1991 | Powell | 416/228 |
| 5,209,644 | 5/1993 | Dorman | 416/235 |
| 5,299,915 | 4/1994 | Dinh et al. | 416/196 R |
| 5,609,470 | 3/1997 | Dodd | 416/235 |

FOREIGN PATENT DOCUMENTS

| | | | |
|---|---|---|---|
| 46-28051 | 8/1971 | Japan | 416/224 |
| 62-113802 | 5/1987 | Japan | 416/241 R |
| 1-219301 | 9/1989 | Japan | 416/241 R |
| 401813 | 2/1974 | U.S.S.R. | 416/241 R |
| 615240 | 7/1978 | U.S.S.R. | 4516 241 R |
| 580806 | 9/1946 | United Kingdom | 415/914 |

*Primary Examiner*—Christopher Verdier

[57] ABSTRACT

A turbine blade which is provided for use in a wet steam region of penultimate and ultimate stages of turbines and is subject to erosive wear caused by impinging water droplets, is treated in a region of leading edges and parts of a blade leaf in such a way as to reduce the erosive wear. In order to reduce the erosive effect of the water droplets, the blade leaf has a surface roughness in the region of its leading edge and its blade back or in at least a partial region thereof. The surface roughness is markedly increased in comparison with the surface roughness of a front side of the blade leaf.

14 Claims, 2 Drawing Sheets

TURBINE BLADE FOR USE IN THE WET STEAM REGION OF PENULTIMATE AND ULTIMATE STAGES OF TURBINES

CROSS-REFERENCE OF RELATED APPLICATION

This application is a Continuation of International Application Ser. No. PCT/EP96/05427, filed Dec. 5, 1996.

BACKGROUND OF THE INVENTION

1. Field of the Invention

The invention relates to a turbine blade which is provided for use in a wet steam region of penultimate and ultimate stages of turbines, which is subject to erosive wear caused by impinging water droplets and which is treated in a region of leading edges and parts of a blade leaf in such a way as to reduce the erosive wear.

In the region of the ultimate stages of a steam turbine or even before they are reached, the expansion of steam has progressed to such an extent that so-called wet steam is generated, that is to say steam which is mixed with very small droplets of condensed water. At the high rotational speed of the turbine, such water droplets impinge on the moving blades at a correspondingly high velocity and lead to highly undesirable erosive wear at their leading edges and on the blade back. Under adverse conditions of use, the maximum permissible stripping of material caused by erosion is reached quickly, so that the useful life of the blades and consequently the service life of the turbine are greatly reduced. At the same time, however, there are also losses of efficiency, since the profile geometry changes. The initially ground relatively smooth surface of the blade leaf is increasingly transformed by erosion into an extremely rough surface which is formed essentially of hard martensite needles that are left standing. The profile and shape of the leading edge are also markedly changed as a result of the erosive stripping. Reliability also drops due to weakening of the cross-section and notches which are made.

In order to alleviate the problems mentioned, the leading edge and parts of the blade leaf of moving blades of the penultimate and ultimate stages are flame-hardened and laser-hardened as a function of the calculated thermal dynamic conditions of use. The purpose of such hardening is to improve the material properties by changing the structural state in such a way that stripping of material caused by impinging water droplets is reduced. Although that has mitigated the relevant problem, it has still not been solved satisfactorily at all.

SUMMARY OF THE INVENTION

It is accordingly an object of the invention to provide a turbine blade for use in the wet steam region of penultimate and ultimate stages of turbines, which overcomes the hereinafore-mentioned disadvantages of the heretofore-known devices of this general type and through the use of which the reliability achieved heretofore, the mean efficiency over the operating time and the useful life of the moving blades affected by drop erosion, are markedly improved.

With the foregoing and other objects in view there is provided, in accordance with the invention, a turbine blade to be used in the wet steam region of penultimate and ultimate stages of turbines, comprising a blade leaf having a front side with a given surface roughness, a blade back and a leading edge; and a surface roughness markedly increased in comparison with the given surface roughness, the increased surface roughness disposed in the vicinity of the leading edge and at least part of the blade back, for reducing erosive wear caused by impinging water droplets.

It may be assumed that the erosive effect of the water droplets impinging on the moving blades is markedly reduced when it becomes possible to build up a water film which brings about damping on the affected surfaces of the moving blades. The surface roughness ensures that the impinging water droplets are first distributed relatively uniformly over the surface as a film which is then constantly supplemented by new droplets.

In accordance with another feature of the invention, the surface roughness is given a specific structure, through the use of which a water film which forms is retained on the surface of the affected moving blade regions better than would be the case if the surface roughness were relatively uniform, despite the effect of centrifugal forces.

In accordance with a further feature of the invention, the structure of the surface roughness is formed by furrows or grooves extending transversely to the centrifugal direction along circles imagined to be coaxial to the turbine shaft or tangentially to the circles.

In accordance with an added feature of the invention, the desired surface roughness is obtained by carrying out suitable surface machining or surface coating, particularly in desired regions.

In accordance with an additional feature of the invention, the surface roughness occurring during the milling of the blade leaf is left unchanged in the corresponding regions of the leading edge and of the rear side, and only the remaining blade leaf regions which are not exposed or are markedly less exposed to erosion are given a correspondingly reduced surface roughness by grinding. The furrows occurring during milling form a suitable structure which holds the water film well, if the milling direction also runs transversely to the direction of the centrifugal force.

In accordance with yet another feature of the invention, the blade leaf has a hardened region or regions where affected by drop erosion. In addition to surface roughness, surface hardening is a further independent, but important factor for improving the properties of the moving blades with regard to droplet erosion.

In accordance with yet a further feature of the invention, the hardening of the blade leaf extends along the leading edge, commencing at the free end of the blade in the direction of the blade root, with a length of two thirds of the length of the blade leaf.

It is necessary to ensure that the region of a damper wire hole provided in the blade is left free in the blade region which undergoes hardening. Therefore, in accordance with yet an added feature of the invention, the hardened region is positioned in such a way that the hardening of the blade leaf, commencing at the free end of the blade, extends along the leading edge as a strip having a width preventing it from touching the damper wire hole, terminating in front of the damper wire hole or leaving the region around the damper wire hole free of hardening.

In accordance with yet an additional feature of the invention, since both hardening and surface roughness serve the purpose of reducing droplet erosion, both are restricted approximately to the same surface regions. However, deviations therefrom in order to satisfy special conditions are possible without difficulty. Thus, for example, the region of increased surface roughness may extend beyond the hardened region and beyond the damper wire hole, without this resulting in any impairment.

In accordance with a concomitant feature of the invention, tests have shown that it is advantageous if the regions of increased surface roughness are about RC=30 to 100 μm, preferably about RC=60 to 70 μm, while the ground or grinding regions are about RC=5 to 20 μm, preferably about RC=10 μm. A roughness of this amount is also produced by the grooves which occur during milling.

Other features which are considered as characteristic for the invention are set forth in the appended claims.

Although the invention is illustrated and described herein as embodied in a turbine blade for use in the wet steam region of penultimate and ultimate stages of turbines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
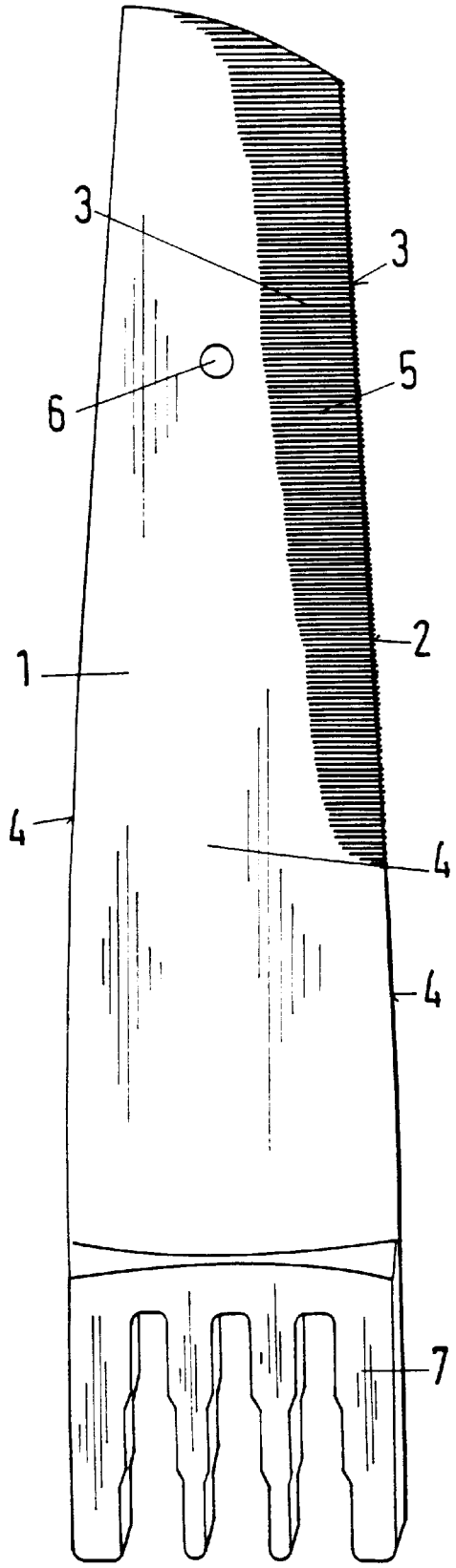
FIG. 1 is a diagrammatic, perspective view of a rear side of a steam turbine moving blade which is improved by hardening and increased surface roughness.

Referring now to the figures of the drawings in detail and first, particularly, to FIG. 1 thereof, there is seen a rear side of a turbine moving blade having a blade leaf or vane 1 with a damper wire hole 6 and a blade root 7. Insofar as the moving blade is used in the wet steam region, it is subject to drop erosion, particularly in the region of its leading edge 2. It is the harmful effects of the drop erosion which are to be minimized. An expedient possibility for minimizing such effects is to reduce the impingement of the water droplets arriving with high kinetic energy, through the use of suitable damping. This is achieved by building up a water film which protects the endangered surface regions. An increased surface roughness 3 which assists the formation of a desired water film and also retains it is therefore provided. The surface roughness 3 extends along the leading edge 2 on the latter and on the rear side of the blade leaf 1. The water film is prevented from flowing off in the direction of the centrifugal force by grooves running transversely thereto. Such grooves already occur during the milling of the blade profile, so that their surface structure can be preserved unchanged. The conventional aftertreatment of the surface is therefore restricted to a grinding region 4 of the remaining surface.

Figure 3:
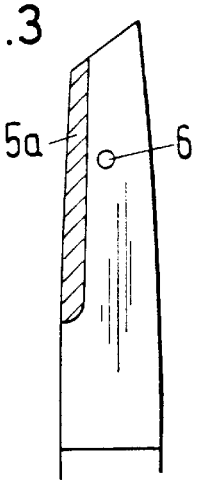
FIG. 3 is an elevational view of a first variant of the blade according to FIG. 1 with a long, narrow, hardened region.
Figure 4:
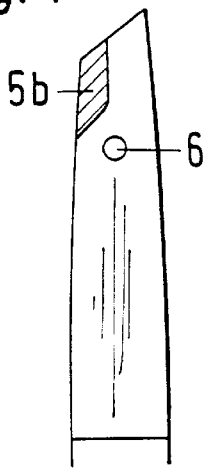
FIG. 4 is an elevational view of a second variant of the blade according to FIG. 1 with a short, wide, hardened region.
Figure 5:
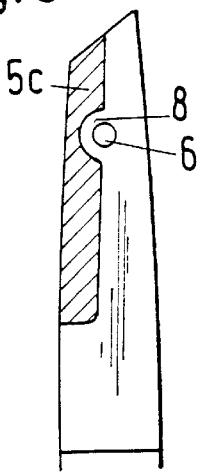
FIG. 5 is an elevational view of a third variant of the blade according to FIG. 1 with a long, wide, hardened region.

A further possibility for reducing the drop erosion of the moving blade is afforded by hardening the affected regions. Such a hardened region 5, like the region of increased surface roughness 3, must therefore extend along the leading edge 2. In this case, however, the region lying directly around the damper wire hole 6 should remain unhardened. The shape and position of the hardened region depend essentially on the size and area of use of the relevant moving blade. However, as may be inferred from FIGS. 3 to 5, as a rule three variants are employed. The first variant according to FIG. 3 shows a hardened region 5*a* which takes up about two thirds of the length of the blade leaf 1, but is so narrow that it remains sufficiently far away from the damper wire hole 6. In the second variant according to FIG. 4, a hardened region 5*b* is markedly wider, but so short that it terminates before the damper wire hole 6 is reached. By contrast, in the third variant according to FIG. 5, the hardened region 5*c* is wide and long, but forms a non-hardened free clearance 8 around the damper wire hole 6.

Figure 2:
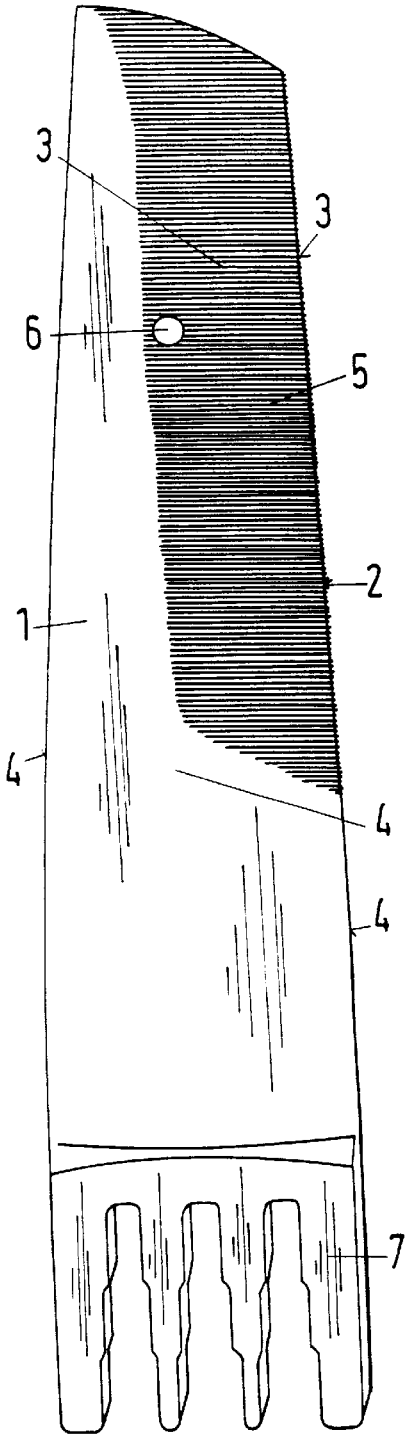
FIG. 2 is a perspective view of a moving blade which corresponds to that of FIG. 1 and in which the region of increased surface roughness extends beyond the hardened region.

While it is necessary to pay attention to the position of the damper wire hole if the hardened region 5 is extended, there is no need for such consideration if the region of increased surface roughness 3 is extended. Therefore it is possible, according to FIG. 2, to extend the region of increased surface roughness 3 beyond the hardened region 5, if necessary. Irrespective of the surface roughness, the damper wire hole itself may be rounded and polished.

We claim:

1. A turbine blade for use in a wet steam region of penultimate and ultimate stages of turbines, comprising:

a blade leaf having a front side with a given surface roughness, a blade back, a hardened region where said blade leaf is affected by drop erosion and a leading edge; and a surface roughness extending beyond said hardened region and increased in comparison with said given surface roughness, said surface roughness disposed in the vicinity of said leading edge and at least part of said blade back, for reducing erosive wear caused by impinging water droplets.

2. The turbine blade according to claim 1, wherein said increased surface roughness is deliberately structured for retaining a water film forming on a blade surface, despite effects of centrifugal forces.

3. The turbine blade according to claim 1, wherein said surface roughness is formed by furrows or grooves extended transversely to a centrifugal direction along imaginary circles coaxial to a turbine shaft.

4. The turbine blade according to claim 1, wherein said increased surface roughness is formed by furrows or grooves extended transversely to a centrifugal direction and tangential to imaginary circles coaxial to a turbine shaft.

5. The turbine blade according to claim 1, wherein said surface roughness is produced by surface machining for retaining a water film.

6. The turbine blade according to claim 1, wherein said surface roughness is produced by surface machining in desired regions for retaining a water film.

7. The turbine blade according to claim 1, including grinding regions having a reduced surface roughness by grinding, boundaries of said grinding regions defined as remaining blade leaf regions outside of said surface roughness that are substantially unexposed to erosion, and wherein said given surface roughness occurs during milling of said blade leaf and is left unchanged in corresponding regions of said leading edge and of said blade back that are not within said surface roughness.

8. The turbine blade according to claim 7, wherein said surface roughness is approximately RC=30 to 100 $\mu$m, and said grinding regions are approximately RC=5 to 20 $\mu$m.

9. The turbine blade according to claim 7, wherein said surface roughness is approximately RC=60 to 70 $\mu$m, and said grinding regions are approximately RC=10 $\mu$m.

10. The turbine blade according to claim 1, including a blade root, said blade leaf having a free end and a given length, and said hardened region of said blade leaf extending along said leading edge commencing at said free end in the direction of said blade root and having a length of about two thirds of said given length.

11. The turbine blade according to claim 10, wherein said blade leaf has a damper wire hole formed therein, and said hardened region of said blade leaf commencing at said free end of said blade leaf extends along said leading edge as a strip having a width small enough to prevent said hardened region from touching said damper wire hole.

12. The turbine blade according to claim 10, wherein said blade leaf has a damper wire hole formed therein, said hardened region of said blade leaf commencing at said free end of said blade leaf extends along said leading edge as a strip having a width small enough to terminate in front of said damper wire hole.

13. The turbine blade according to claim 10, wherein said blade leaf has a damper wire hole formed therein, said hardened region of said blade leaf commencing at said free end of said blade leaf extends along said leading edge as a strip having a width small enough to leave a region around said damper wire hole free of hardening.

14. The turbine blade according to claim 1, wherein said increased surface roughness is restricted to said hardened region.

* * * * *